United States Patent [19]

Myers

[11] 3,933,624

[45] Jan. 20, 1976

[54] SLURRY SYSTEM FOR REMOVAL OF CONTAMINANT FROM SYNTHETIC OIL

[75] Inventor: Gary A. Myers, Plano, Tex.

[73] Assignee: Atlantic Richfield Company, Los Angeles, Calif.

[22] Filed: Jan. 23, 1974

[21] Appl. No.: 435,637

[52] U.S. Cl. ..... 208/253; 208/251 H; 208/89

[51] Int. Cl.[2] ..... C10G 17/00

[58] Field of Search ..... 208/253, 251 H, 251, 89

[56] References Cited

UNITED STATES PATENTS

| | | | |
|---|---|---|---|
| 3,069,350 | 12/1962 | Ramella | 208/253 |
| 3,573,201 | 3/1971 | Annesser et al. | 208/253 |
| 3,622,498 | 11/1971 | Stolfa | 208/251 H |
| 3,788,973 | 1/1974 | Wolk et al. | 208/251 |
| 3,804,750 | 4/1974 | Myers et al. | 208/253 |

*Primary Examiner*—Herbert Levine
*Assistant Examiner*—Juanita M. Nelson
*Attorney, Agent, or Firm*—James C. Fails

[57] ABSTRACT

A method for removing a contaminant comprising at least one of arsenic and selenium from a synthetic crude oil or fraction thereof characterized by mixing with the synthetic crude oil feed (1) particles of a material that is either iron, cobalt, nickel, oxides or sulfides of these metals, or a mixture thereof, and (2) hydrogen, and heating the mixture in a reaction zone to deposit said contaminant(s) on said particles. A liquid product stream comprising the synthetic crude oil without the contaminant(s) is recovered, leaving a thickened slurry. All or a portion of the thickened slurry can be withdrawn from the process and all or a part of the slurry can be mixed with fresh synthetic feed. Also disclosed are specific and preferred process details.

15 Claims, 1 Drawing Figure

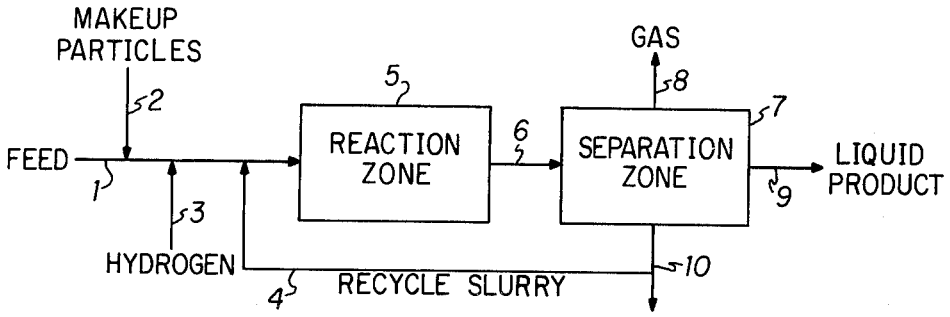
MAKEUP
PARTICLES
2
FEED
1
3
HYDROGEN
4
RECYCLE SLURRY
5
REACTION
ZONE
6
SEPARATION
ZONE
GAS
8
7
LIQUID
PRODUCT
9
10

SLURRY SYSTEM FOR REMOVAL OF CONTAMINANT FROM SYNTHETIC OIL

BACKGROUND OF THE INVENTION

1. Field of the Invention

This invention relates to a method of removing catalyst-poisoning impurities, or contaminants; such as, arsenic or selenium; from hydrocarbonaceous fluids; such as, synthetic crude oil and synthetic oil fractions.

2. Description of the Prior Art

There has been a resurgence of interest in sources of energy that were formerly noncompetitive. These sources of energy include shale oil, fluids obtained from coal, bitumen obtained from tar sands, and the like. Many of these hydrocarbonaceous (i.e., not composed exclusively of hydrogen and carbon) fluids contain contaminants that could poison expensive catalysts, such as those used in hydrogenation and other processes to which these hydrocarbonaceous fluids must be subjected before they can be satisfactorily transported and used as sources of energy. The best prior art of which I am aware is disclosed in a co-pending application Ser. No. 314,015, filed Dec. 11, 1972 now abandoned in favor of Ser. No. 421,139, filed Dec. 3, 1973, with co-inventor Donald K. Wunderlich and entitled "Synthetic Oil Treatment." That descriptive matter will be briefly summarized hereinafter for the reader's convenience. The prior art has included a method for removing arsenic from hydrocarbon charge stocks, such as described in U.S. Pat. No. 2,778,779. Such methods have included using the iron, nickel and cobalt oxides to remove arsenic from streams of naturally occurring crude, such as naphtha or straight run gasoline. By employing the oxides at low temperature, such as from room temperature to about 200°F, by disregarding the atmosphere under which the reaction takes place, and by using substantial amounts of water, the oxide acts as an oxidizing agent and oxidizes the arsenic to a water soluble arsenic oxide. In this way the arsenic oxide is dissolved in the water and removed from the naturally occurring crude oil or oil fraction.

Also, arsenic has been removed from similar naturally occurring crude oils by contacting them with a metallic salt of a strong acid at low temperature, such as room temperature, without regard to the atmosphere under which the contacting takes place. In this particular process, it was taught that oxides do not work for removing arsenic and this process is disclosed in U.S. Pat. No. 2,781,297.

Processes that work for removing other contaminants, or catalyst-poisoning materials, such as organometallic compounds like iron porphyrins, are frequently inoperable for removing impurities like arsenic. For example, the catalytic hydrogenation of hydrocarbons to effect the precipitation of an insoluble iron salt of the iron prophyrin within a hydrogenating catalyst, as described in U.S. Pat. No. 3,496,099, cannot be employed satisfactorily in removing arsenic from synthetic crudes of the like.

The invention described in Ser. No. 314,015 improved significantly on the prior art, but had one drawback that prevented its being totally satisfactory. The contaminant tended to be concentrated in a surface layer about 30 microns thick, so the center portion of the larger pellets and the like were not useful and available for removing the contaminant.

In fact, none of the prior art processes have been completely satisfactory in removing catalyst-poisoning impurities, such as arsenic, from synthetic crude oil and synthetic oil fractions.

SUMMARY OF THE INVENTION

Accordingly, it is an object of this invention to provide a method of removing contaminants from a feed stream of synthetic crude or the like that does not require the use of aqueous, or hydrophilic, solutions and alleviates the difficulties of the prior art.

More specifically, it is an object of this invention to provide a method of removing a contaminant from a feed stream that accomplishes the foregoing object and provides relatively long contact time and a high level of activity in the system at all times, yet requiring small, economically feasible vessels, such as reactors, and separators.

These and other objects will become apparent from the descriptive matter hereinafter.

The foregoing objects are achieved in accordance with this invention by mixing with the synthetic crude oil feed (1) particles of a material that is either iron, cobalt, nickel, oxides or sulfides of these metals, or a mixture thereof, and (2) hydrogen, and heating the mixture in a reaction zone to deposit the contaminant(s) on the particles of the material present. A gas stream containing hydrogen can be separated, leaving the slurry. A liquid stream comprising the synthetic crude oil without the contaminant can be separated from the slurry, leaving a thickened slurry. All or a portion of the thickened slurry can be withdrawn from the process and all or part of the slurry can be mixed with fresh synthetic feed that has not yet been treated to remove contaminant(s).

BRIEF DESCRIPTION OF THE FIGURES

The FIGURE is a flow diagram of one embodiment of this invention.

DESCRIPTION OF PREFERRED EMBODIMENTS

To facilitate understanding, the treatment of a stream of a synthetic crude with the particles of the material for removing the contaminant will be described hereinafter.

The drawing shows one embodiment within this invention wherein fresh feed in pipe 1 has added thereto fresh (makeup) particles of iron, etc., if any is added, by way of pipe 2, hydrogen by way of pipe 3, and any recycle slurry by way of pipe 4, after which the resulting mixture enters reaction zone 5 wherein it is heated and the contaminants deposit out on the particles present in the mixture. The mixture then passes by way of pipe 6 to separation zone 7 wherein hydrogen containing gas is removed from the mixture by way of pipe 8. Essentially contaminant free oil is removed as the product of the process by way of pipe 9 and the remaining slurry of liquid and particles is removed by way of pipe 10 for removal from the system or recycle in pipe 4 or a combination thereof.

In carrying out this invention, the particles of material are injected into the feed stream of synthetic crude to remove the contaminant of arsenic or selenium, whether in elemental or combined form. The particles of material preferably have a surface area of at least 1 square meter per gram, still more preferably having a surface area of at least 50 square meters per gram. The active ingredient; such as, the iron oxide or iron sulfide;

for example, the crushed and sieved pellets of a conventional carbon monoxide shift catalyst; can be employed by itself in the particles or may be employed in combination with a conventional support (carrier); such as, silica, alumina, magnesia, zirconia, thoria, zinc oxide, chromium oxide, silicon carbide, or naturally occurring carriers, like clay, Kieselguhr, Fuller's earth, pumice, bauxite and the like, or in any combination of two or more thereof whether naturally occurring or prepared. As indicated hereinbefore, the particles of material are minus six (−6) mesh (pass through a 6 mesh, U.S. Standard or Tyler, screen) or smaller in order to form a slurry more advantageously and be more readily recycled or pumped through pipelines and the like.

In this embodiment, the particles are first slurried with syncrude and then the resulting slurry is injected into the syncrude feed line already maintained at elevated pressure. The procedure and equipment for forming and admixing the slurry is conventional; for example, the conventional equipment for admixing cement for subterranean bore hole cementing operations, or for admixing drilling or fracturing fluids for use with wells penetrating subterranean formations.

In any event, the injected particles in combination with the syncrude stream forms a dilute slurry at elevated pressure. The dilute slurry is combined with a stream of high pressure hydrogen. The resulting admixture of dilute slurry and hydrogen is heated. The heat may be supplied by heating the constituents individually before admixing them or the heat may be supplied to the admixture. In any event, the admixture of dilute slurry and hydrogen is heated to a temperature of at least 300°F, and preferably at least to 700°F. Still more preferably, the admixture of dilute slurry and hydrogen is heated to temperatures in the range of about 700°F to about 850°F.

The hot, or heated, admixture is sent to a high pressure, high temperature reactor. The reactor may be heated. The reactor is sized to provide, in conjunction with flow lines and separators, a residence time of at least about 1 minute and preferably 5 minutes or longer. Also, the reactor is maintained at a pressure of at least 500 pounds per square inch gauge (psig), preferably, at least 1,500 psig. This allows sufficient time for the syncrude to intimately contact the particles of material, even on their interior via the passageways and pores that exist within the particles.

At the elevated temperature and in the hydrogen atmosphere, there is a removal of the contaminant from the feed stream. Specifically, the contaminant, such as the arsenic, is dispersed in the matrix of the material in a manner analogous to adsorption phenomena such that it is removed in non-water soluble form.

After suitable reaction time in the flow lines, and the reactor in the hydrogen atmosphere, the admixture of the particles of material, syncrude and hydrogen pass to a first separator, or first separating means, where the gas stream is separated from the admixture. The gas stream comprises hydrogen together with any other gaseous constituents that may be formed at the elevated temperature as a result of the treatment of the syncrude. Ordinarily, the additional gaseous constituents will be minor in the absence of a hydrogenation catalyst.

The remaining dilute slurry comprising the particles of the material and the syncrude are then passed to a second separator, or second separation means.

In the second separating means, a portion of liquid syncrude without the contaminant, is passed off as an effluent stream to be sent to further processing, such as downstream hydrogenation. A recycle stream comprising a more concentrated slurry of the particles of the material and the liquid, or syncrude, is returned to a point upstream; for example, injected into intimate contact with the incoming syncrude at least by the time it reaches the high temperature reactor. For example, the recycle slurry may be injected at the same point at which the solids are injected into the incoming syncrude; at any point upstream of the reactor; or into the high temperature, high pressure reactor itself. It has been satisfactory to inject the recycle slurry into the reactor. A portion of the recycle slurry is withdrawn. The portion that is withdrawn is sized so as to withdraw an amount of the small particles that is equal to the first amount of small particles that are injected into the incoming feed stream, or incoming syncrude. The portion is withdrawn before the remainder of the recycle slurry is injected into intimate contact with the incoming syncrude.

The first separation means may comprise a conventional gas-liquid separator with conventional liquid level controls.

The second separation means may comprise any of the conventionally available means. These conventional means comprise centrifuges that subject the particles to centrifugal force to sling them to the outside such that the center portion will be particle-free liquid. The centrifuges may be conventional centrifuges or they may be of the type employed for recycling Barite or the like in processing drilling mud. Illustrative of the latter types of centrifuges is one described in U.S. Pat. Nos. 3,400,819, issued Sept. 10, 1968 and 3,433,312, issued Mar. 18, 1969, the descriptive matter of which is embodied herein by reference.

On the other hand, a second separation means may comprise quiescent settling tank with very low velocity of movement therein so as to allow the solids to settle to the bottom so they can be drawn as a concentrated slurry and allow withdrawal of the supernatant liquid from the top. If desired, a conventional reactor, such as the lime-soda ash reactor employed in water treating may be used and allow the liquid to be withdrawn from a quiescent zone. All of these second separation means are well known and do not need to be described further herein.

The portion of the recycle slurry that is withdrawn may be withdrawn per se and the particles subsequently separated from the liquid phase. On the other hand, if desired, a third separation means may be employed to effect separation of the liquid phase and a recycling of the liquid phase, either to form a slurry with the dry particles that are injected into the incoming syncrude, or injected directly into the reactor. For example, a centrifuge separator such as described hereinbefore may be advantageously employed to draw off the particles and allow recycling of the liquid without substantial decrease in pressure. The solid particles may then be processed as appropriate either to remove the arsenic for commercial use or to regenerate the particles for reinjection, or both. A co-worker, Mr. Ralph Styring, has invented and filed a patent application on a method for processing solid particles. The patent application is entitled "Method of Removing Contaminant from Spent Contaminant-Removing Material," filed Jan. 23, 1974, Ser. No. 435,760 assigned to the assignee of this application. That method is applicable for treating the withdrawn particles of material that contain the contaminant, such as arsenic removed in accordance with this invention, and its descriptive matter is incorporated herein by reference.

Any amount of the particles of material can be employed in the process of this invention as long as the resulting dilute slurry formed with admixture with the syncrude is a pumpable slurry that does not tend to accumulate, or pile up, solid particles in piping, fittings, heat exchangers (if employed) and the like. The more particles of material that are present in the syncrude the more nearly complete will be the removal of the contaminant, or impurity.

This invention has an inherent advantage in that the liquid-solid contact time can be relatively long with economically sized vessels, particularly if the syncrude and solids are heated before or near the point of mixing, or at least by the point of admixture with the hydrogen gas. Thus, there is a turbulence of intermixing and a relatively long mutual "reaction", or residence, time that results in a more nearly complete removal of the contaminant from the syncrude by the time the slurry of particles of the material and the syncrude have passed through the piping, the reactor and the separators.

The withdrawal of the recycle slurry and the particles therein maintains the proportion of particles in equilibrium, with a constant make-up and withdrawal; and maintains a constant "activity," or potential for removal of the contaminant from the syncrude, in the system. Moreover, the use of the small particles effects a more nearly complete use of all of the material, since even the center portions of the small particles are useful and available for interdispersing the contaminant; instead of having a layer of only about 30 microns thick on a larger particle in which the contaminant is dispersed. Thus, the process inherently effects a greater efficiency in the use of the material in removing the contaminant.

While the oxides and sulfides of the iron have been described specifically hereinbefore, the particles of material that are useful in this invention as active materials may comprise the nickelic, ferric, cobaltic, ferrous, nickelous, and cobaltous forms. For example, ferric oxide, both $Fe_2O_3$ and $Fe_3O_4$, nickelic oxides $Ni_2O_3$ and $Ni_3O_4$, and cobaltic oxides $Co_2O_3$ and $Co_3O_4$, can be employed. Similar reasoning is applicable to the comparable sulfides of the metals and to the ferrous, cobaltous and nickelous forms of the oxides and sulfides.

While the injection of a slurry containing the particles of the material has been described hereinbefore, the dry particles of material may be injected directly into a low pressure stream of the syncrude by suitable apparatus, such as the bins and blenders for admixing drilling mud particles, such as Barite and clay, into drilling fluids for forming the low pressure drilling fluid for drilling bore holes into subterranean formations. The resulting low pressure syncrude containing the particles of materials slurried therewith can then be elevated in pressure employing conventional pumps, such as the pumps employed to elevate the pressure of a drilling fluid, or the like.

It is within the scope of this invention to employ a single reaction zone or a plurality of separate reaction zones. The reaction zones can be employed in series (staged) or in parallel or a combination thereof.

From the foregoing, it can be seen that this invention effects the objects set out hereinbefore and alleviates the difficulties of the prior art processes.

Having thus described the invention, it will be understood that such description has been given by way of illustration and example and not by way of limitation, reference for the latter purpose being had to the appended claims.

What is claimed is:

1. A method of removing a nonmetallic contaminant comprising at least one of arsenic and selenium in elemental or combined form from a synthetic hydrocarbonaceous fluid obtained from normally solid coal, oil shale or tar comprising mixing said hydrocarbonaceous fluid with (1) particles of a material selected from the group consisting of iron, cobalt, nickel, at least one oxide of said metals, at least one sulfide of said metals and a combination thereof; said particles being of a size sufficient to form a slurry with said hydrocarbonaceous fluid; and (2) hydrogen; heating at an elevated pressure said slurry and hydrogen mixture in a reaction zone to a temperature sufficient to effect in conjunction with said elevated pressure removal of said contaminant from said hydrocarbonaceous fluid and deposition of said contaminant on said particles; said temperature being less than that which substantially alters the character of said hydrocarbonaceous fluid; and recovering a liquid product stream comprising said hydrocarbonaceous fluid essentially free of said contaminant from the thus treated slurry.

2. A method according to claim 1 wherein said particles are of a size which passes through a 6 mesh screen.

3. A method according to claim 1 wherein said hydrogen is mixed with said hydrocarbonaceous fluid under elevated pressure, and the mixture is treated in said reaction zone under a temperature of at least about 300°F. and a pressure of at least about 500 psig.

4. A method according to claim 1 wherein besides said product stream, a gas stream containing hydrogen is also recovered thereby leaving a thickened slurry suitable for reuse with fresh contaminant containing feed, and recycling at least part of said thickened slurry to said reaction zone.

5. A method according to claim 4 wherein said recycled slurry is injected into said hydrocarbonaceous fluid upstream of said reaction zone.

6. A method according to claim 4 wherein said recycled slurry is injected into said reaction zone to admix with said hydrocarbonaceous fluid and said small particles of said material therein.

7. A method according to claim 1 wherein said small particles are admixed with said hydrocarbonaceous fluid to form a slurry first and said slurry is thereafter injected into said hydrocarbonaceous fluid to facilitate injection at elevated pressure; and said hydrocarbonaceous fluid and said hydrogen are provided at said pressure of at least 500 psig upstream of said reaction zone.

8. A method according to claim 7 wherein said temperature of at least 300°F. is also provided upstream of said reaction zone for longer reaction time.

9. A method according to claim 1 wherein said temperature is in the range of from about 700° to about 850°F. and said pressure is at least about 1,500 psig.

10. A method according to claim 1 wherein said liquid is separated from said thickened recycle slurry by centrifugation.

11. A method according to claim 1 wherein said particles are separated from said recycle slurry by centrifugation such that said small particles of said material are available for regeneration and reuse and the remainder of said portion of said recycle slurry is available for return to the reaction zone.

12. A method according to claim 1 wherein a plurality of reaction zones is employed.

13. A method according to claim 12 wherein said plurality of reaction zones is employed in series.

14. A method according to claim 12 wherein said plurality of reaction zones is employed in parallel.

15. A method according to claim 12 wherein said plurality of reaction zones is employed in a combination of series and parallel.

* * * * *